US006808106B1

(12) United States Patent
Grigsby et al.

(10) Patent No.: US 6,808,106 B1
(45) Date of Patent: Oct. 26, 2004

(54) RESTRICTED PORT AIR BREATHABLE BULK MATERIALS CONTAINER

(75) Inventors: Charles F. Grigsby, Marietta, GA (US); Jeffrey C. Banks, Mableton, GA (US)

(73) Assignee: North American Container Corporation, Mableton, GA (US)

( * ) Notice: Subject to any disclaimer, the term of this patent is extended or adjusted under 35 U.S.C. 154(b) by 0 days.

(21) Appl. No.: 10/225,556

(22) Filed: Aug. 21, 2002

(51) Int. Cl.[7] ..... B65D 005/00
(52) U.S. Cl. ..... 229/120
(58) Field of Search ..... 229/120, 199.1, 229/122.32; 220/913, 676; 47/84

(56) References Cited

U.S. PATENT DOCUMENTS

| | | | | |
|---|---|---|---|---|
| 1,407,688 A | | 2/1922 | Banton | |
| 2,533,773 A | | 12/1950 | De La Foret | |
| 2,841,319 A | | 7/1958 | White et al. | |
| 3,040,954 A | * | 6/1962 | Salmon | 229/120 |
| 3,071,045 A | | 1/1963 | Budd | |
| 3,369,728 A | * | 2/1968 | Royce | 229/120 |
| 3,486,680 A | | 12/1969 | Negus, Jr. | |
| 3,492,853 A | | 2/1970 | Gross | |
| 3,507,667 A | * | 4/1970 | Magnen | 229/120 |
| 3,786,708 A | | 1/1974 | Mumper | |
| 4,487,539 A | | 12/1984 | Taylor et al. | |
| 4,513,907 A | * | 4/1985 | Grossbuesch | 229/120 |
| 4,515,266 A | | 5/1985 | Myers | |
| 4,561,579 A | | 12/1985 | Fleming, III et al. | |
| 4,586,627 A | | 5/1986 | Grigsby | |
| 4,635,815 A | | 1/1987 | Grigsby | |
| 4,941,572 A | | 7/1990 | Harris | |
| 5,575,418 A | | 11/1996 | Wu et al. | |
| 5,772,107 A | * | 6/1998 | Younger | 229/120 X |
| 6,079,304 A | | 6/2000 | Bisceglia | |
| 6,126,067 A | | 10/2000 | Grigsby, Jr. et al. | |
| 6,212,982 B1 | | 4/2001 | Augustin et al. | |

FOREIGN PATENT DOCUMENTS

JP 64/326359 8/1991 ..... 229/120

OTHER PUBLICATIONS

U.S. patent application Ser. No. 09/994,176, Grigsby, Jr. et al., filed Nov. 26, 2001.

Wood–Cleated Corrugated North American Container Corp. (Mableton, Georgia, Lawrenceburg, Tennessee) Since 1967–Leader in Heavy Duty Wood–Cleated and Laminated Corrugated Containers.

* cited by examiner

*Primary Examiner*—Tri M. Mai
(74) *Attorney, Agent, or Firm*—Baker Donelson Bearman Caldwell & Berkowitz

(57) ABSTRACT

A container for leaf product and other bulk pack materials wherein a blank of corrugated paperboard is scored to define side walls of the container, and a plurality of openings are defined in at least one side wall of the container and closed with an air permeable sheet to define passageways for communication of moisture from the container to the atmosphere for drying and long term storage of the leaf products while restricting communication of particulates, contaminants, and dust between the container and atmosphere. A method of defining restricted passageways in the blank of corrugated paperboard is disclosed.

11 Claims, 5 Drawing Sheets

RESTRICTED PORT AIR BREATHABLE BULK MATERIALS CONTAINER

TECHNICAL FIELD

The present invention relates to containers for holding and storing bulk materials. More particularly, the present invention relates to air-breathable containers that facilitate communication from the container of moisture emitted from a load of bulk materials such as agriculture leaf products that require substantial air movement throughout the load held in the container for drying and long-term storage.

BACKGROUND OF THE INVENTION

Large-volume containers are often used for holding, storing, and transporting bulk materials, such as powders, agriculture leaf and root crop products, metal castings, plastic resins, and many other materials. Generally, the containers provide sturdy walls for protecting the bulk materials from entry of pests and from container failure while allowing the containers to be handled by equipment such as fork lift trucks and platen trucks. The containers are also often stacked in warehouses.

Some containers also facilitate the drying and curing of the bulk materials. For example, some agriculture leaf products require significant air movement throughout a load of such products for drying or curing the products without formation of biological contamination such as mold or fungus growth that may occur in stagnant air conditions. These agriculture products include peanuts, fruits, grains, vegetables, and leaf products.

Often, leaf products particularly are held in containers made with wood-slats that are secured together with enwrapping metal bands. There are gaps between adjacent edges of the wood slats in the wall of the container. As the leaf products emit moisture and dry, the moisture communicates from the container through the gaps to the atmosphere. The escape of the moisture prevents mold from attacking the leaf products. These containers also allow for long-term storage of the leaf products. This enables the products to cure to useful raw material. The containers have sturdy walls which enable the containers to be stacked for storage in warehouses.

In addition, raw tobacco leaf products are generally processed with heat and steam. Typically packed at around 100 degrees F., the leaf products in the loaded container experience rising heat and giving off of steam for about the first 12 to 24 hours. Excessive heat rise may cause damage to leaf products, such as char or burning which destroys the value of the product. Generally, after the first day, the temperature typically decreases to ambient levels. However, the first 12 to 24 hours are important to the release of temperature and moisture, and containers for such leaf products must accommodate temperature rise and moisture communication.

Also because the total weight of a single loaded container may run as high as fifteen hundred (1500) pounds, the packing and shipping of bulk materials presents several unique problems. One problem is that such bulk materials are typically poured or thrown into the container and shipped loose so that the packed materials "flow" about the interior of the container. Materials of lesser densities may be pressed or compacted during filling of the container. After filling, the memory of the packed material exerts an outward force on the side walls of the pack. The side walls of the container must be sufficiently rigid in the horizontal plane to withstand internal movement or expansion of the materials and thereby must resist against bulging as a result of internal material flow.

Another problem is that the side walls of the container must also be sufficiently rigid to permit stacking of one container on top of another. The side walls must provide sufficient compression strength to prevent any deformation or collapse of the container when others are stacked upon it. Warehouse storage of containers with product often stacks containers 4 or 5 containers high. To meet stacking requirements, containers must withstand designed 4:1 loading. For example, 1200 pound loads in containers in a warehouse stack five high impose a load of 4800 pounds on the bottom container. As a safety factor, the containers must therefore accomodate four times the expected load, or 19,200 pounds of compression strength (generally tested at standard conditions of 73° F. and 50% relative humidity).

In addition to the requirement that the container facilitate air and moisture communication, the container needs to restrict entry of pests into the walls of the container and into the load packaged therein, to reduce pest contamination and destruction of the product.

U.S. Pat. No. 4,635,815 describes a corrugated paperboard container having an exterior tubular corrugated paperboard body laminated to an interior tubular corrugated paperboard body, and includes of support members fixedly secured between the exterior and interior bodies so as to reinforce the container. While this container has been successful in long-term storage of bulk materials, it has not been gainfully used with fresh leaf products. The corrugated paperboard would prevent escape of moisture from the container. The leaf products would become damaged by mold and decay which leads to lost value. The leaf products must first dry by removal of the moisture held in the leaf products before long term storage can be made successfully with paperboard-type containers. However, transfer of such leaf products from the wood slat containers to the corrugated paperboard container after drying is not efficient. The wood slat containers have drawbacks to their continued use for leaf products. These problems include the costs and availability of such containers.

U.S. Pat. No. 6,126,067 describes a corrugated paperboard container having at least one side panel with a plurality of openings defined by drilling through the side panel with a non-fluted drill, whereby the openings provide for communicating moisture through the panel and outwardly of the container. While this container satisfactorily facilitates drying of leaf products, some believe there are drawbacks which may limit the use of such containers. Particularly, the open flutes in the corrugated side panel may become occluded such as with dust particles carried by the communicated air, and the effectiveness of the container for drying leaf products may be reduced.

Co-pending U.S. patent application Ser. No. 09/994,176 describes a corrugated paperboard container having at least one side panel with a plurality of openings defined by punching through the side panel with a tapered pin, whereby the openings provide for communicating moisture through the panel and outwardly of the container while a portion of the outer paperboard sheet at least partially covers the flutes in the opening as it is formed. While this container satisfactorily facilitates drying of leaf products, some believe there are drawbacks which may limit the use of such containers. Particularly, the open flutes in the corrugated side panel may not be uniformly closed, and the opening may become occluded such as with dust particles carried by the communicated air, thereby reducing the effectiveness of the container for drying leaf products.

Accordingly, there is a need in the art for an improved air-breathable container that facilitates communication from the container of moisture emitted from the leaf products held in the container for drying and long-term storage. It is to such that the present invention is directed.

BRIEF SUMMARY OF THE INVENTION

The present invention solves the above-described problems in the prior art by providing a container that facilitates communication of moisture from the container for drying and long-term storage of leaf products. The container comprises a blank of a corrugated paperboard sheet having a flute sheet interposed between opposing paperboard sheets and scored to define two opposing end panels and two opposing side panels. The blank is foldable on the scores and a pair of opposing distal ends are adhered together to define a tubular body openable from a first position which is substantially flat to a second position squared-open for receiving a plurality of leaf products within a cavity defined by the opposing end and side panels. At least one of the panels defines a plurality of spaced-apart passageways for communicating moisture through the panel. The panel defines a compressed portion about a perimeter of each of the passageways, which portion is substantially compressed relative to a thickness of the panel, whereby the flutes of the panel are significantly closed. An air permeable sheet attaches to the panel in overlapping relation to each of the passageways. A bottom closes a first open end of the tubular body and a top cap closes a second open end of the tubular body. The leaf products, being held within the tubular body, emit moisture which communicates through air permeable sheet on the panel to atmosphere for drying and long-term storage of the leaf products.

In another aspect, the present invention provides an air-permeable container having an outer wall-forming blank of corrugated paperboard scored to provide a series of main panels foldably joined together and a second wall-forming blank of corrugated paperboard also scored to provide a series of main panels foldably joined together. The second wall-forming blank bonds to the inside surface of the first wall-forming blank. A plurality of support members are fixedly retained about a perimeter of each main panel between the first wall-forming blank and the second wall-forming blank. At least one of the main panels in the first and second wall-forming blanks define a plurality of spaced-apart passageways. A plurality of air permeable sheets attach to the second wall-forming blank in overlying relation to the passageways. The unitary container accordingly facilitates communication of moisture from leaf products through the air permeable sheets to atmosphere while the reinforced side walls provide compression strength and prevent against any bulging.

In another aspect, the present invention provides a container for drying and long-term storage of leaf products made by the process comprising the steps of:

(a) providing a blank of a sheet material scored to define two opposing end panels and two opposing side panels;

(b) pressing a die against the sheet material, the die having at least one cutter to define a passageway therethrough and the die further including a resilient body around a perimeter of the cutter and extending from the die substantially as far as the cutter, whereby a portion of the sheet material about the passageway is substantially compressed thereby while the passageway is cut therein by passage of the die against the sheet material;

(c) attaching an air permeable patch to the sheet material overlying each one of the passageways;

(d) folding the blank on the scores;

(e) adhering a pair of opposing distal ends of the blank adhered together to define a tubular body openable from a first position which is substantially flat to a second position squared-open for receiving a plurality of leaf products within a cavity defined by the opposing end and side panels; and (f) providing a bottom and a top cap that close opposing open ends of the tubular body, whereby leaf products, being held within the tubular body, emit moisture which communicates through the air permeable patches covering the passageways in the panel to atmosphere for drying and long-term storage of the leaf products.

Objects, advantages and features of the present invention will become apparent from a reading of the following detailed description of the invention and claims in view of the appended drawings.

DETAILED DESCRIPTION OF THE ILLUSTRATED EMBODIMENTS

Figure 1:
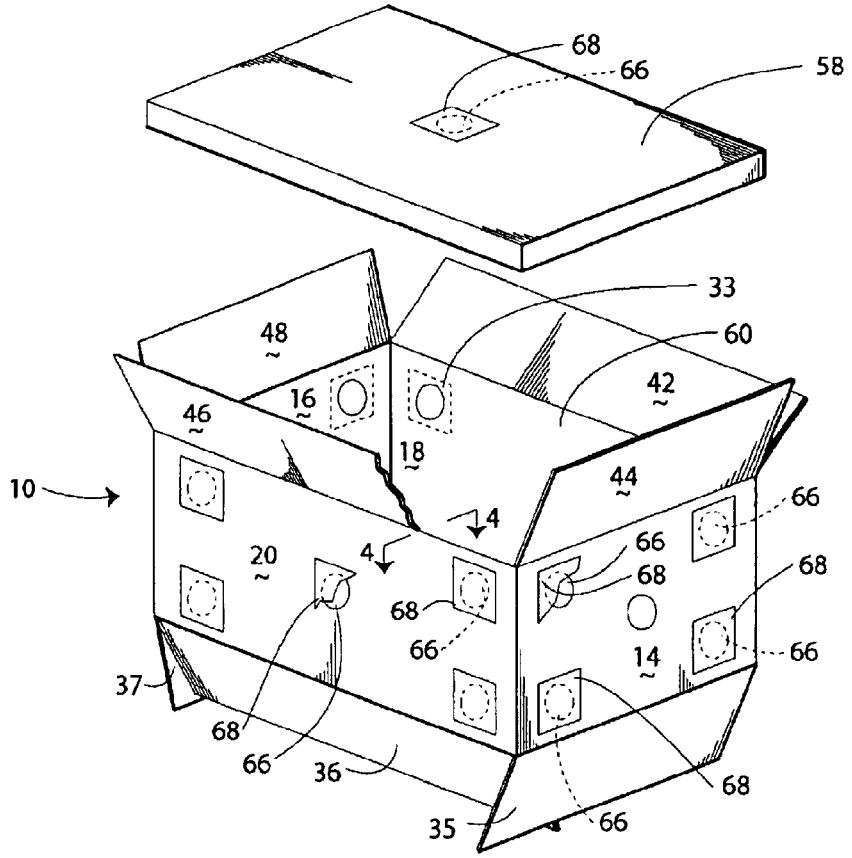
FIG. 1 is a pictorial view of an embodiment of a bulk material container according to the present invention.
Figure 2:
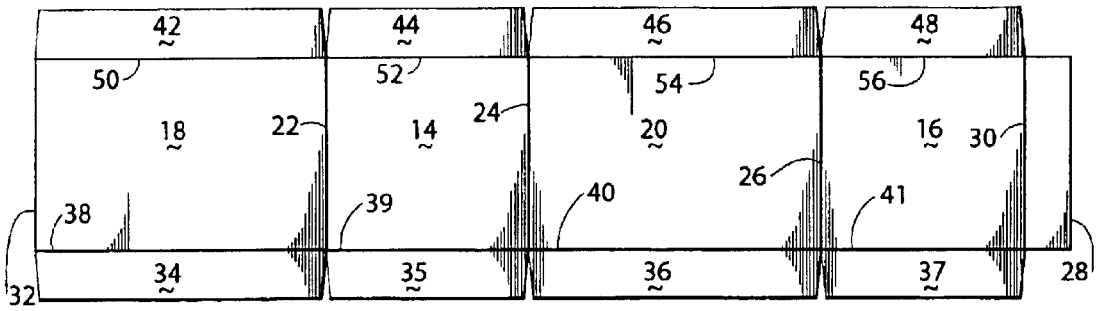
FIG. 2 is a plan view of a paperboard blank for forming the bulk material container illustrated in FIG. 1.

Referring now in more detail to the drawings, in which like numerals indicate like parts throughout the several views, FIG. 1 illustrates a container 10 of the present invention for holding bulk materials for drying and long-term storage. The container 10 is formed from a blank of sheet material 12 illustrated in FIG. 2. The sheet material 12 is preferably corrugated paperboard made conventionally with fluted sheet sandwiched by linerboard also known as paperboard or fiberboard. The sheet material 12 includes two opposing end panels 14, 16 and two opposing side panels 18, 20 foldably connected along scores 22, 24, and 26. The end panels 14, 16 and the side panels 18, 20 define the sides of the container 10 shown in FIG. 1. A manufacturer's joint flap 28 foldably connects on a score 30 to the end panel 16. The manufacturer's joint flap 28 attaches with adhesive to a side portion 32 of the side panel 18 to form a tubular body for the container 10. The scores 22, 24, 26, and 30 permit the container 10 to substantially flatten to a knock-down position for shipping from a container manufacturer to a company using the container. For use, the container 10 is squared-open as in FIG. 1 to define a cavity 33 for holding bulk materials.

FIG. 1 further shows a series of four bottom flaps 34, 35, 36, and 37 foldably attached to the end and side panels 14, 16, 18, and 20, respectively, along scores 38, 39, 40, and 41. Similarly, a series of four top flaps 42, 44, 46, and 48 foldably attach on an opposing side of the end and side panels 14, 16, 18, and 20, respectively, along scores 50, 52, 54, and 56.

FIG. 1 further shows a cap member 58 positioned immediately above the container 10. The cap member 58 may be formed of any suitable material, such as corrugated paperboard blank, and is provided for closing off the top of the container 10. Thus, the cap member 58 is dimensioned so as to fit snugly over the top of the container 10. The cap member 58 made with corrugated fiberboard defines a main panel 60 with side flaps 62 foldably joined along scores 64 and connected conventionally at corners, such as with tape or interlocking portions.

Those skilled in the art will recognize that FIG. 1 shows no bottom support member such as a pallet or a slip sheet under the bottom of the container 10. Various bottom support members could be provided including, but not limited to, pallets, slip sheets and bottom caps. Such bottom support members are well known in the art, and are not disclosed further herein. Thus, it is to be understood that the present invention has applications other than through conventional corrugated paperboard containers. For example, the present invention may take the form of a tube-like container consisting of only side walls with no top or bottom flaps, but having top and bottom caps similar to the top cap 58.

The container 10 of the present invention is breathable for communication of air and moisture from the cavity 33 to the atmosphere. At least one of the panels 14, 16, 18, and 20 defining the walls of the container 10 is provided with a plurality of passageways 66. In the illustrated embodiment, each of the opposing end and side panels 14, 16, 18, and 20 are provided with the passageways 66. A plurality of air permeable sheets 68 attach to the blank 12. Each sheet 68 overlies a respective one of the passageways 66. The sheets 68 covering the passageways 66 permit moisture to pass from the cavity 33 to atmosphere, while reducing passage of contaminants, dust, particulates, pests, and the like into the cavity. In an alternate embodiment, a single sheet attaches to the main panel in overlying relation to the passageways 66, rather than separate patches or sheets 68. The sheets 68 define air permeable substrates which restrict passage of particulates, dust, and the like while permitting passage of air and moisture to the atmosphere. For example, a sheet useful in the container of the present invention is a 6.5 ounce uncoated polypropylene fabric available from Ling Industrial Fabrics, Inc., of Summerville, S.C., product item number I00041. In the illustrated embodiment, two passageways are defined in opposing lower portions of the main panel and in opposing upper portions with one passageway centrally disposed in the main panel and another in the cap 58, to facilitate communication of air and moisture between the container and atmosphere.

Figure 3:
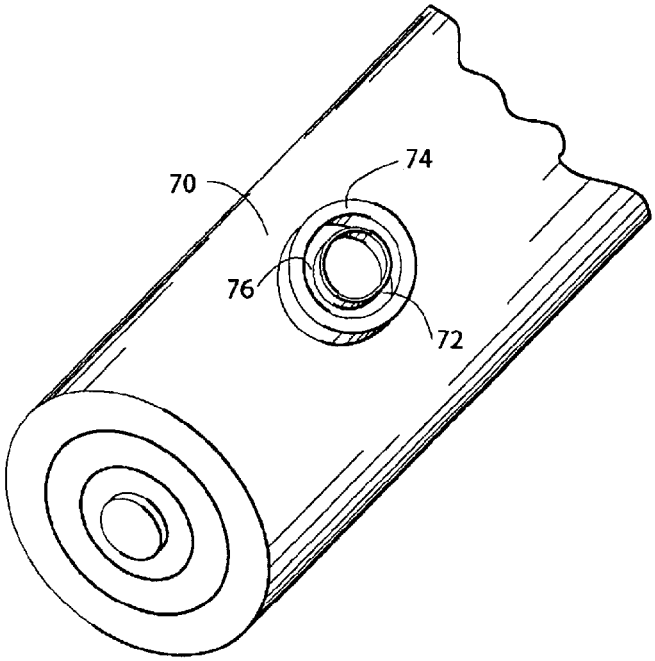
FIG. 3 is a perspective view of a roller die for forming passageways in side panels of the bulk material container illustrated in FIG. 1, for communicating moisture emitted from the materials in the container to atmosphere.

FIG. 3 is a perspective view of a portion of a roller die 70 for forming the passageways 66 in the corrugated paperboard blanks used with the present invention. A knife 72 defining the shape and size of the passageways 66 projects radially from the roller die 70. The knife 72 is a thin metal member capable of piercing the corrugated paperboard to form the opening for the passageway 66. In the illustrated embodiment, the passageways 66 are circular, as reflected by the annular configuration of the knife 72. A crush member 74 is concentrically spaced from the cutter 72. The crush ring 74 is a firm, substantially rigid member although with some resilience. The crush ring 74 extends radially from the roller die 70 and is spaced slightly apart from the cutter 72 to define a gap 76 between an inside edge of the crush member 74 and the cutter 72. The crush member 74 in the illustrated embodiment is an annular ring that extends substantially the same distance outwardly as the knife 72.

Figure 4:
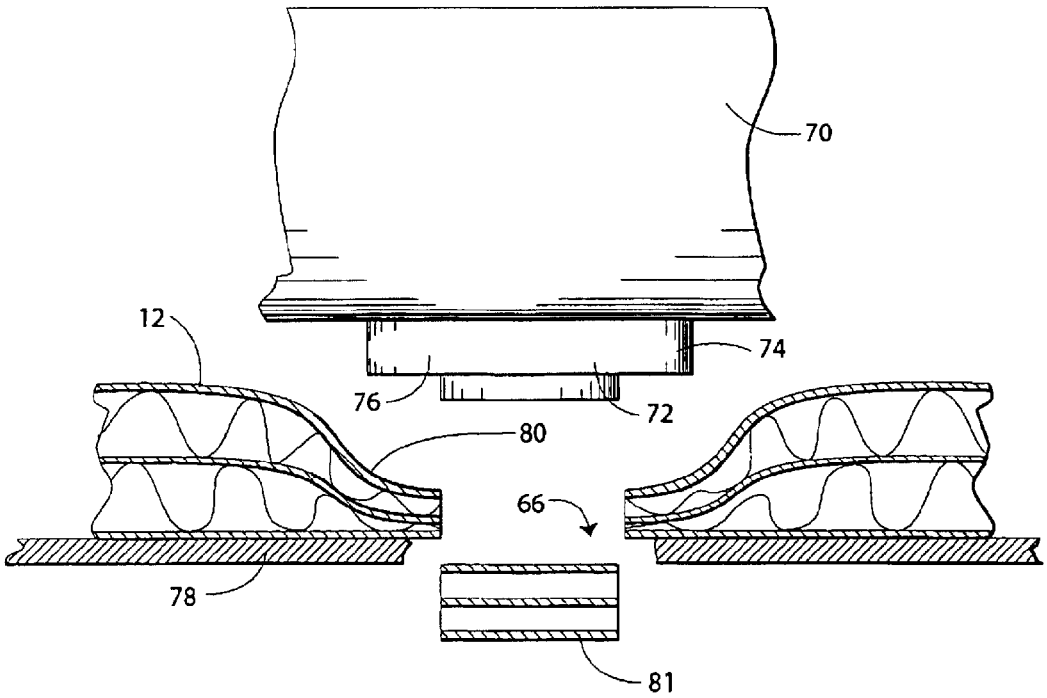
FIG. 4 is a side elevational view illustrating the passageway formed by the roller die illustrated in FIG. 3, according to the present invention.

FIG. 4 is a side view illustrating the roller die 70 on a manufacturing line where the blank 12 of corrugated paperboard passes between a support 78 and the roller die 70. The knife 72 rolls into the blank 12 as it passes on a conveyor between the roller die 70 and the support 78. The crush member 74 bears firmly against the portions of the corrugated blank 12 outwardly of the knife 72. The crush member 74 crushes the corrugated paperboard to form a compressed zone generally 80 about the perimeter of the opening that defines the passageways 66. A cut out portion 81 is separable from the blank 12.

Figure 5:
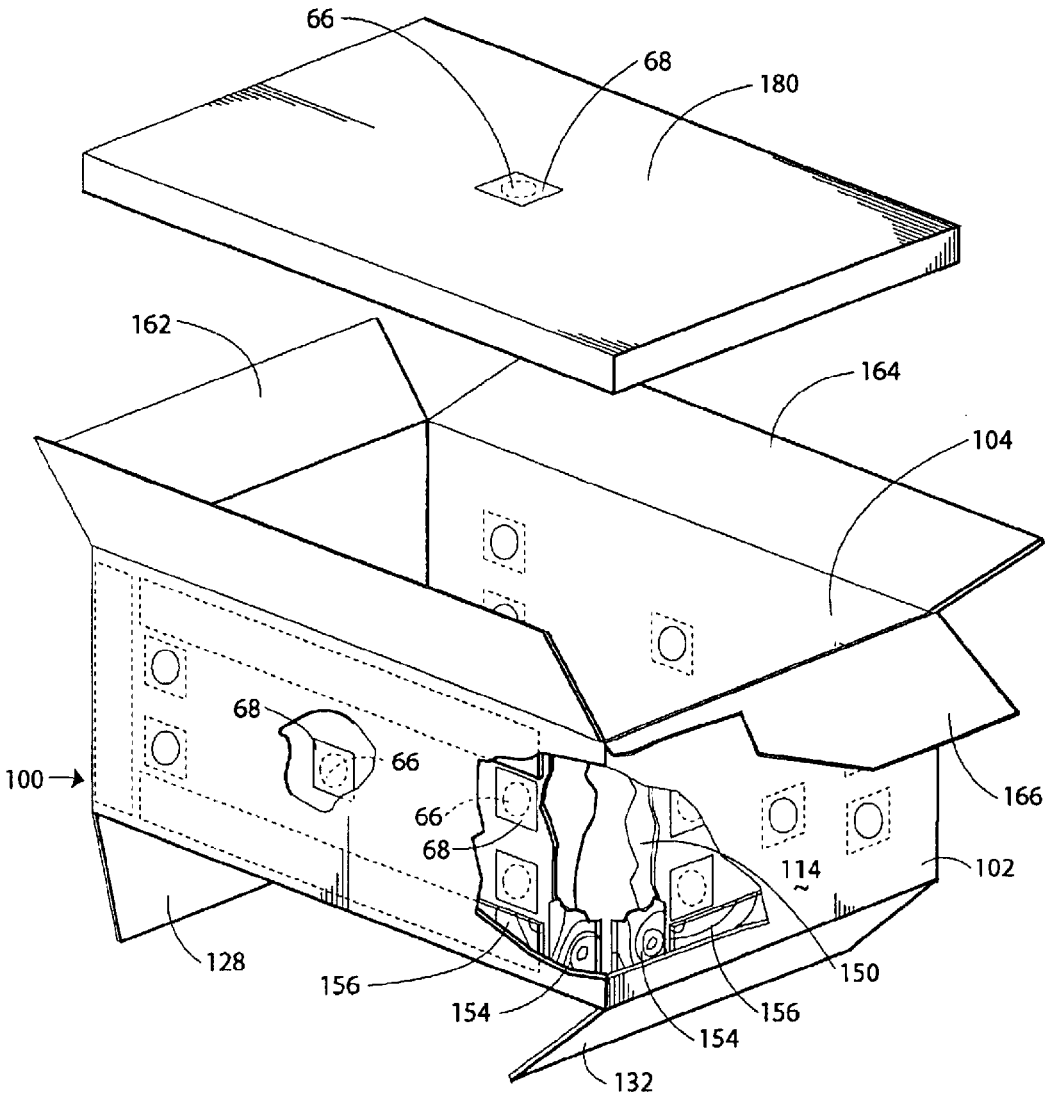
FIG. 5 is a perspective view of an alternate embodiment of a bulk material container according to the present invention, with a portion cut away to illustrate support members.
Figure 6:
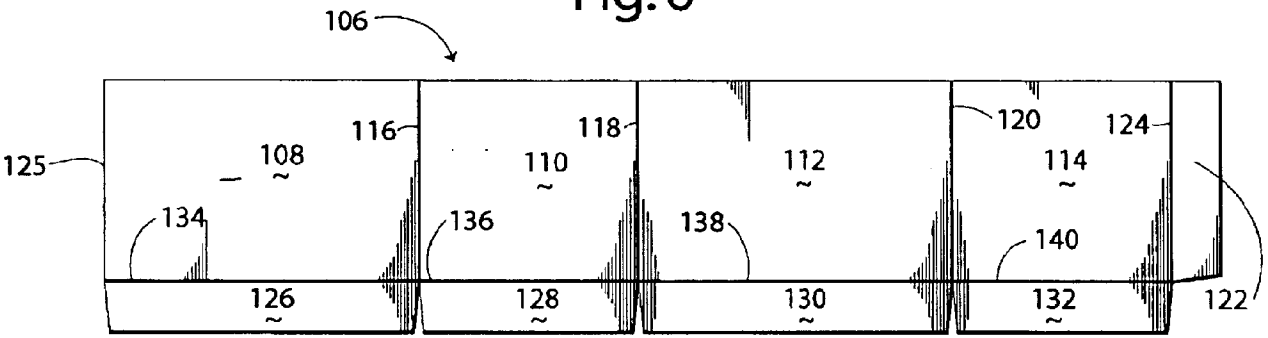
FIG. 6 is a plan view of a paperboard blank for forming an outer shell of the container shown in FIG. 5.

FIG. 5 illustrates an alternate embodiment of the container according to the present invention, which container 100 is formed with an outer shell 102 and an inner liner 104 and includes support members as discussed below. FIG. 6 illustrates a plan view of a blank 106 of a sheet material suitable for forming the outer shell 102. The preferred sheet material is corrugated paperboard conventionally formed of fluted sheet sandwiched between linerboard, fiberboard, or paperboard sheets. The outer shell blank 106 includes four main is panels 108, 110, 112, 114 foldably connected along three score lines 116, 118, and 120. The four main panels 108, 110, 112, 114 form the four outer side walls of the container 100 as shown in FIG. 5. A manufacturer's joint flap 122 is foldably connected to the main panel 114 along a score line 124. The outer shell joint flap 122 attaches to a side portion 125 of the panel 108 to form a collapsible tubular body for the container 100, as described below. Those skilled in the art will appreciate that the outer shell 102 may be modified so that manufacturer's joint flap 122 is positioned within the container 100 instead of lapped over the outside. Such an arrangement is also well-known in the art. A series of four bottom flaps 126, 128, 130 and 132 are foldably connected to the main panels 108, 110, 112, and 114, respectively, along respective score lines 134, 136, 138, and 140.

Figure 7:
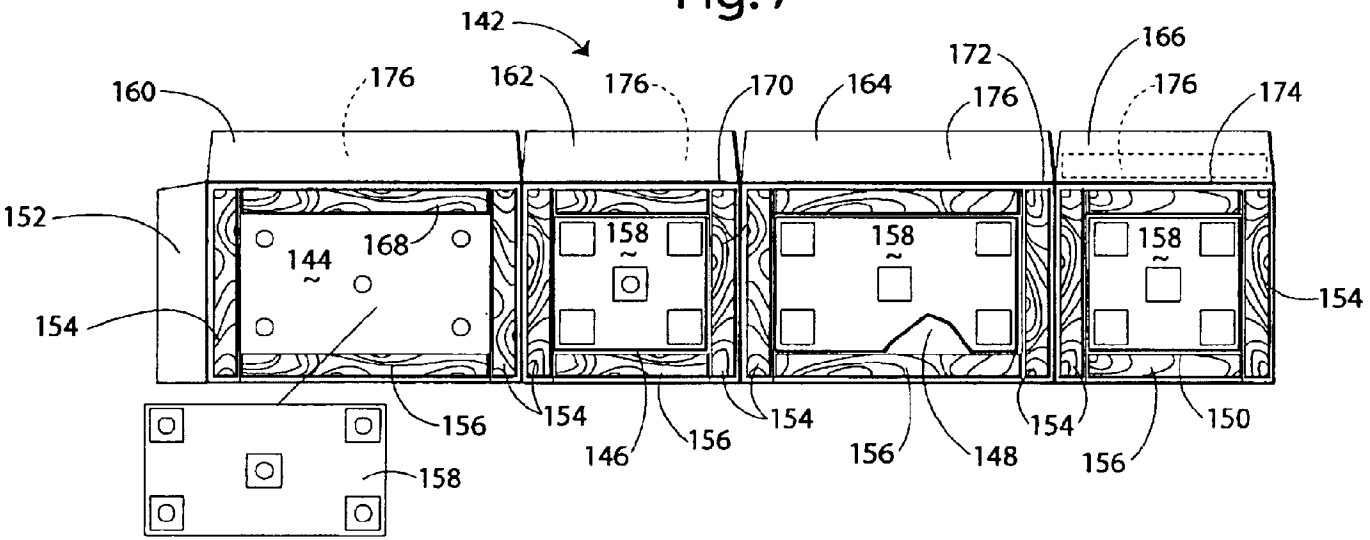
FIG. 7 is a plan view of a paperboard blank for forming the depth liner or inner wall portion of the container shown in FIG. 5, showing the reinforcing members and spacer pads bonded to the depth liner.

FIG. 7 shows a blank 142 of sheet-like material suitable for forming the inner liner 104. While other materials may be used, the preferred material is corrugated paperboard. The inner liner blank 142 includes four main panels 144, 146, 148, and 150, defined by scores in the blank. The main panels 144, 146, 148, and 150 form the four innermost side walls of the container 100 when the inner liner 104 is bonded to the outer shell 102 as described below. The inner liner blank 142 provides a joint flap 152 foldably connected to the main panel 144 along a score line 154. The joint flap 152 attaches with adhesive to a side portion of the panel 150.

A plurality of reinforcing or support members (vertical 154, horizontal 156) are bonded to a first side surface of the blank 142 about a perimeter of each main panel 144, 146, 148 and 150. The first side surface of the blank 142 (shown in FIG. 7) is that side of the inner liner 104 that is to be engaged to the outer shell 102. The support members 154, 156 may be formed of any suitably rigid material. A particularly preferred material is a wood veneer, typically ranging in thickness from ⅛ inch to ½ inch and in width from 2 and ¾ inches to 3 and ¾ inches. The length of the support members 154 depends upon the height of the container 100. Preferably, the length of the vertical support members 154 is substantially equal to the height of the depth liner 104, which is, in turn, substantially equal to the interior or inside height of the container 100.

The support members 154, 156 are preferably secured to the main panels 144, 146, 148, and 150 using any suitable adhesive. The vertical support members 154 provide supporting effect to the corners when the container 100 is squared-open and erected for use. The vertical support members 154 are preferably bonded as close to the corners as possible, but not so close as to prevent the container from being folded down into a substantially flat position. Additionally, in order to further increase container rigidity and compression strength, a support member may be bonded near the center or otherwise intermediate of the outer ends of the main panels 144, 146, 148, and 150 (not illustrated).

The inner liner 104 further includes four filler pads 158 with one attached to each of the main panels 144, 146, 148, and 150. The filler pads 158 are formed of any suitably rigid sheet material. A particularly preferred material is corrugated paperboard. The thickness is preferably equal to that of the members 154 and 158. For example, the filler pads 158 are preferably doublewall corrugated paperboard. The filler pads 158 attach to the blank 142 with adhesive or other suitable bonding material. The filler pads 158 fill the volume between the support members 156 and 158, to provide a substantially level face for the inner liner 104 which adheres to the outer shell 102, as discussed below.

An alternate embodiment (not illustrated) does not use the horizontal supports 156. The filler pads 158 in this embodiment extend the full height of the inner liner 104. Furthermore, the blanks 106 and 142 may be conventionally formed of paperboard having substantially vertical corrugations. However, the tiller pads 158 are preferably made of paperboard having substantially horizontal corrugations. Of course, the blanks 106 and 142 may be formed of paperboard with horizontal corrugations and the filler pads 158 formed of paperboard with vertical corrugations.

The blank 142 further includes a series of four top flaps 160, 162, 164, and 166 foldably joined to the main panels 144, 146, 148, and 150, respectively, along respective score lines 168, 170, 172, and 174.

The blanks 106, 142 and the filler pads 158 each define the passageways 66 in the main panels as discussed above. The respective passageways 66 in the blanks 106, 142 and filler pads 158 align to form air channels through the sidewalls of the assembled container 100. The patches 68 are attached with adhesive to the face of the filler pads 158 overlying the passageways 66 in the filler pads. It is to be appreciated that an air permeable sheet may be included as a layer within corrugated paperboards specially manufactured for use as the filler pad. In that embodiment, the layer of sheet material would be sandwiched between adjacent paperboard sheets in the formation of double wall corrugated paperboard in conjunction with defining the openings therein for the passageways 66.

The container 100 is manufactured in accordance with the following method. The outer shell blank 102 and the inner liner blank 142 are manufactured as discussed above with respect to FIGS. 6 and 7. The outer shell blank 102, the inner liner blank 142, and the filler pads 158 are preferably formed of double wall corrugated paperboard. As shown in the drawings, the double wall paperboard is particularly well suited for practice of the embodiment of the present invention. The passageways 66 are formed in the main panels of the blanks 106, 142 separately, as discussed above, using the roller die 70. Similar passageways 66 are formed in the filler pads 158. The passageways 66 in the filler pads 158 are covered with the air permeable sheets 68.

Figure 8:
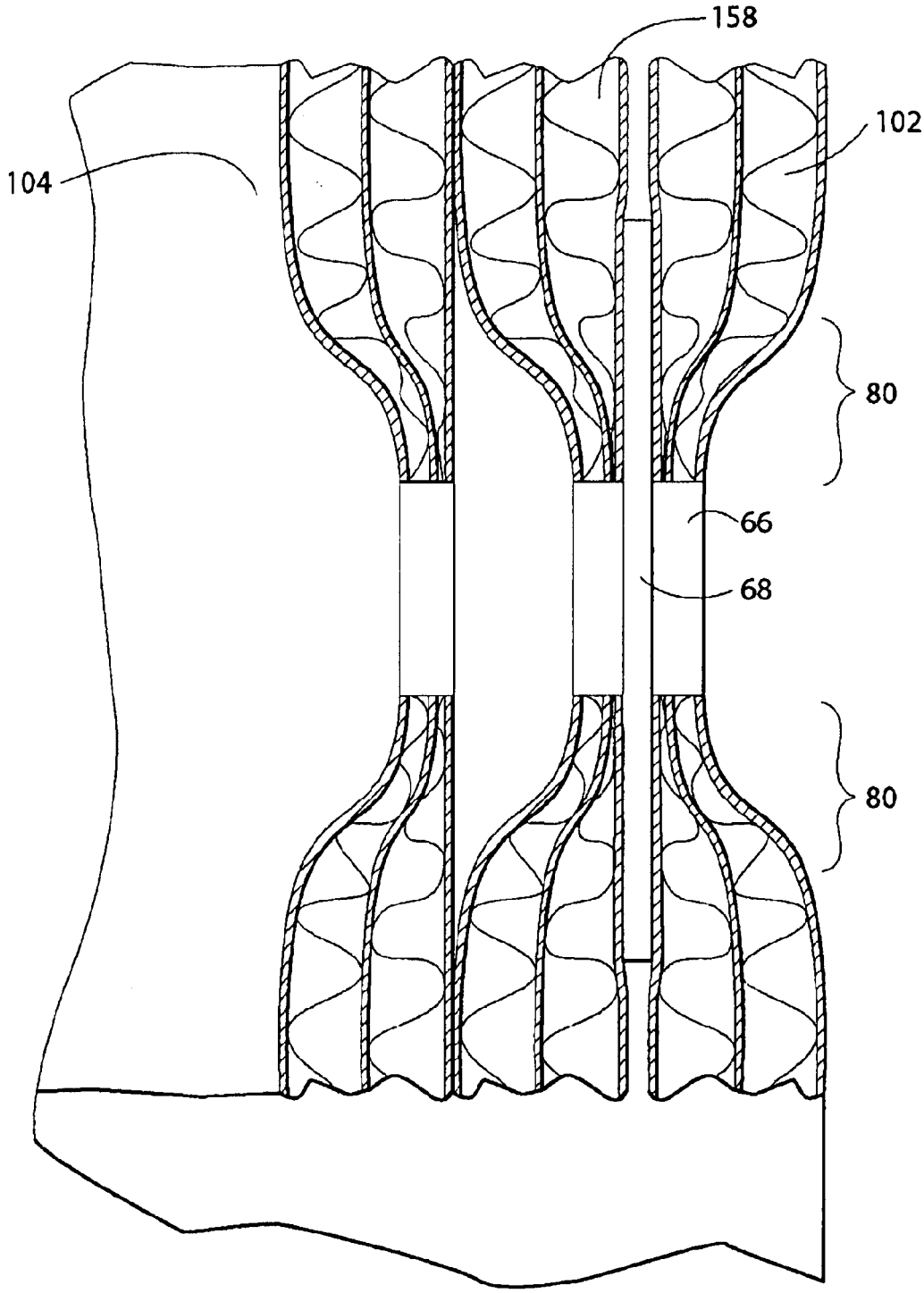
FIG. 8 is a side sectional view illustrating the structure of the container in the. vicinity of the passageways according to the present invention.

FIG. 8 is detailed cross-sectional view of a sidewall of the container 100 in the vicinity of one of the passageways 66. As illustrated, the air permeable sheets 68 closes the openings 66 inwardly of the wall of the container to restrict passage of contaminants, dust and particulates while allowing the passage of air and moisture from the container to atmosphere. The crush zone generally 80 about the perimeter of the passageways 66 substantially closes the flutes of the double wall corrugated paperboard defining the outer liner 102 and the inner liner 104, whereby contaminants, dust, and particulates are restricted from entry into the inner wall of the container 100.

The support members 154, 156 are then bonded to the paperboard blank 142. More particularly, the first side (or inside) of each main panel 144, 146, 148, and 150 of the depth liner blank 142 is provided with a wood support member 154 at its respective left and right edge portion. As described above, the support members 154 are preferably maintained a distance away from a corner portion of the container so as to provide for the containers being knocked down prior to shipment. The members 156 are attached to side portions with adhesive or bonding material. Further, the filler pads 158 are attached to the first side of the blank 142.

Those skilled in the art will appreciate that the dimensions of the support members 154 (as well as the density of the paperboard) may be varied to provide a desired container strength. Those skilled in the art will further appreciate that additional support members 154 may be added intermediate those shown at the left and right edge portions of the main panels 144, 146, 148, and 150 if the particular application of the present invention requires such.

Once the support members 154, 156 and the filler pads 158 are glued or otherwise bonded to the inner liner 104, the blank 142 may be bonded to the outer shell 102 in the conventional manner. A preferred method is to extrude or roll an adhesive material either onto the outer shell 102 or the inner liner 104. The blanks 106 and 142 are then aligned together and passed through a compression device, thereby bonding same.

The joint tabs 152 and 122 are then adhered to respective surfaces of the panel 158 and 108, to form a tubular, collapsible container 100 illustrated in FIG. 6.

Prior to use, the knocked-down container 100 is squared-open to define the cavity for receiving bulk materials. The bottom flaps 126, 128, 130, and 132 are folded towards the respective opposing flap on the respective scores 134, 136, 138, and 140 to close the open lower end of the container 100. The top flaps 160, 162, 164, and 166 are folded outwardly to bring the respective member 176 into contact with the respective outside surfaces of the panels 108, 110, 112, and 114 of the outer shell 102.

An alternate embodiment (not illustrated) does not provide the top flaps 160, 162, 164, and 166 in the blank 142 shown in FIG. 8. In this embodiment, a separate cap 180 similar to cap 58 is used to close the container 100, as illustrated in FIG. 5 with the cap 180 positioned immediately above the container 100. The cap 180 may be formed of any suitable material, such as corrugated paperboard, and is provided for closing off the top of the container 100. Thus, the cap 180 is dimensioned so as to fit snugly over the top of the container 100. The cap 180 includes one of the sheet-covered passageways 66.

Thus, the present invention provides an improved breathable bulk material container particularly suited for holding agriculture and leaf products for drying and long-term storage. Moisture communicates through the passageways 66 of the side walls of the container 100, while the air permeable sheets 68 restrict passage of contaminants, particulates, dust, and pests between the container and atmosphere thereby providing for long term storage of agriculture and leaf products. The crush portions 80 about the perimeters of the passageways 66 further restrict pestual entry into the walls of the container, as well as restrict entry of contaminants, particulates, and dust. The support members 154 provide the container with an increased side wall rigidity for both stacking strength and bulge resistance. The members 156 provide additional side wall strength for handling of the container 100. The placement of the support members 154, 156 between the outer shell 102 and the inner liner 104 insures that the bulk materials stored within the container 100 are not disturbed or damaged by such support members during filling, handling and storage of the containers. The present invention furthermore provides a one-piece, integral unit that can be knocked down flat for shipment to an end user and easily and quickly set up by an end user.

This specification has described the preferred embodiments of the present invention, including the steps necessary for fabricating the preferred embodiments disclosed. It is to be understood, however, that numerous changes and variations may be made in the construction of the present container within the spirit and scope of the present invention. It should therefore also be understood that the foregoing specification relates only to the preferred embodiments of the present invention and that modifications and changes may be made therein without departing from the scope thereof as set forth in the appended claims.

What is claimed is:

1. A container for drying and long-term storage of moisture-emittive products, comprising:

a blank of a corrugated paperboard sheet having a flute sheet interposed between opposing paperboard sheets, said corrugated paperboard sheet scored to define two opposing end panels and two opposing side panels, foldable on the scores and a pair of opposing distal ends thereof adhered together to define a tubular body openable from a first position which is substantially flat to a second position squared-open for receiving a plurality of moisture-emittive products within a cavity defined by the opposing end and side panels;

at least one of the panels defines a field of spaced-apart passageways for communicating moisture through the panel, the panel defining a compressed portion about a perimeter of each of the passageways, which portion is substantially compressed relative to a thickness of the panel, whereby the flutes of the panel are significantly closed thereby;

an air permeable patch attached to the panel in overlying relation to each one of the passageways;

a bottom that closes a first open end of the tubular body and a top cap that closes a second open end of the tubular body, whereby the moisture-emittive products, being held within the tubular body, emit moisture which communicates through the field of passageways in the panel to atmosphere for drying and long-term storage of the products.

2. The container as recited in claim 1, wherein the bottom comprises a plurality of bottom flaps, each foldably attached on a score to a respective one of the opposing end and side panels on a first edge of the blank.

3. The container as recited in claim 1, wherein the top cap comprises a plurality of top flaps, each foldably attached on a score to a respective one of the opposing end and side panels on a second edge of the blank.

4. The container as recited in claim 1, wherein each opening has a diameter of about 2½ inches.

5. The container as recited in claim 1, wherein each panel defines a plurality of said passageways, with at least two of said passageways in an upper portion, two of said passageways in a lower portion, and one of said passageways centrally disposed.

6. The container as recited in claim 1, wherein the top cap defines a second passageway; and further comprising a second air permeable patch attached thereto in overlying relation to the second passageway, for communicating moisture through the top cap.

7. A container for drying and long-term storage of leaf products made by the process comprising the steps of:

(a) providing a blank of a sheet material scored to define two opposing end panels and two opposing side panels;

(b) pressing a die against the sheet material, the die having at least one cutter to define a passageway therethrough and the die further including a resilient body around a perimeter of the cutter and extending from the die substantially as far as the cutter, whereby a portion of the sheet material about the passageway is substantially compressed thereby while the passageway is cut therein by passage of the die against the sheet material;

(c) attaching an air permeable patch to the sheet material overlying each one of the passageways;

(d) folding the blank on the scores;

(e) adhering a pair of opposing distal ends of the blank adhered together to define a tubular body openable from a first position which is substantially flat to a second position squared-open for receiving a plurality of leaf products within a cavity defined by the opposing end and side panels; and (f) providing a bottom and a top cap that close opposing open ends of the tubular body, whereby leaf products, being held within the tubular body, emit moisture which communicates through the air permeable patches covering the passageways in the panel to atmosphere for drying and long-term storage of the leaf products.

8. A reinforced bulk material container, comprising:

a first wall-forming blank of paperboard scored to provide a series of main panels foldably joined together at a plurality of corners, said first wall-forming blank defining an inside surface and an outside surface;

a second wall-forming blank of paperboard scored to provide a series of main panels foldably joined together at a plurality of corners, said second wall-forming blank defining a front side surface and a back side surface;

a plurality of support members fixedly retained about a perimeter of each main panel between the backside of said second wall-forming blank and the first wall forming blank;

at least one of the main panels in the first wall-forming blank and in the second wall-forming blank each defining a plurality of passageways;

a plurality of air permeable sheets, each attached in overlying relation to a respective one of the passageways in the second wall forming blank;

said backside surface of said second wall-forming blank being laminated to said inside surface of said first wall-forming blank so as to provide a unitary container having a series of reinforced side walls with the passageways in the main panel of the first wall-forming blank aligned with the passageways in the second wall-forming blank;

whereby moisture from products placed in the interior of said container communicates through said passageways.

9. The reinforced bulk material container as recited in claim 8, further comprising a filler pad bonded to each main panel of said second wall-forming blank within the perimeter defined by the support members, said filler being formed of corrugated paperboard and defining a field of passageways that align with the passageways in the first and second wall-forming blanks.

10. The reinforced bulk material container as recited in claim 8, further comprising a plurality of top flaps foldably joined to the upper edge portion of the wall panels of the second wall-forming blank for being foldably overlapped over a upper edge of the first wall-forming blank.

11. The reinforced bulk material container as recited in claim 8, further comprising a bottom and a top that close opposing open ends of the container.

* * * * *